United States Patent [19]

Imazeki et al.

[11] Patent Number: 4,525,718

[45] Date of Patent: Jun. 25, 1985

[54] ANTENNA WITH COAXIAL CONNECTOR

[75] Inventors: Kazuyoshi Imazeki; Nobuaki Yokoyama, both of Tokyo, Japan

[73] Assignee: General Research of Electronics, Inc., Tokyo, Japan

[21] Appl. No.: 471,895

[22] Filed: Mar. 3, 1983

[51] Int. Cl.[3] ..... H01Q 1/50

[52] U.S. Cl. ..... 343/702; 343/906; 343/901

[58] Field of Search ..... 343/705, 715, 906, 901, 343/904, 905; 174/153 A; 455/89, 90, 99

[56] References Cited

U.S. PATENT DOCUMENTS

| | | | |
|---|---|---|---|
| 3,296,620 | 1/1967 | Rodda | 343/705 |
| 3,702,480 | 11/1972 | Byars | 343/906 |
| 4,090,030 | 5/1978 | Lagasse | 343/715 |

*Primary Examiner*—Eli Lieberman

*Attorney, Agent, or Firm*—Trexler, Bushnell & Wolters, Ltd.

[57] ABSTRACT

An antenna defines a coaxial connector receptacle when the antenna is in a fully retracted position.

8 Claims, 3 Drawing Figures

ANTENNA WITH COAXIAL CONNECTOR

BACKGROUND OF THE INVENTION

This invention relates generally to telescoping, rod-type antennas, and more particularly a device for enabling such an antenna, mounted in a portable radio set or the like, to connect with an external coaxial connector.

Portable radio sets are generally provided with a telescoping antenna which is both retractable into the radio case or housing and extendable therefrom. It is often desirable to electrically connect the radio input which normally receives signals from this antenna to another, external antenna or to an external connector from a test apparatus.

Such electrical connection may be provided independently of the antenna itself, by mounting a suitable jack or other connector to the radio housing and providing suitable leads from this jack or other connector to the desired input of the radio in common with the inputs thereto from the antenna. However, when a telescoping antenna is utilized, it is necessary to first fully retract the telescoping antenna before utilizing such an auxiliary jack, to prevent interference from signals which would otherwise be picked up by the extended antenna.

Advantageously, the present invention provides such an auxiliary jack as a part of the antenna itself, eliminating the extra expense of providing such an auxiliary jack or other connector, the mounting thereof to the radio housing or casing and the interconnection of leads therefrom to the radio inputs. Moreover, the invention provides such a connector which is adapted to accept an external cable or other connection only when the antenna is in the fully retracted position, thus automatically eliminating any problem of interference from the antenna itself.

Accordingly, it is an object of this invention to provide means for connecting a telescoping antenna of a radio set to an external coaxial cable.

In accordance with one embodiment of this invention, the free outer end of the telescoping antenna and an antenna mount base together form a coaxial female connector or receptacle.

BRIEF DESCRIPTION OF THE DRAWINGS

The foregoing as well as other objects, features and advantages of the invention will be more readily appreciated upon reading the following detailed description of the illustrated embodiment together with reference to the drawings, wherein.

DETAILED DESCRIPTION OF THE ILLUSTRATED EMBODIMENT

Figure 1:
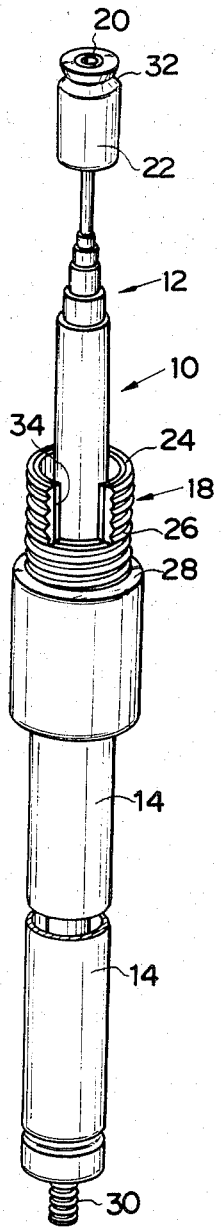
FIG. 1 is a perspective view of an antenna constructed according to this invention, shown in a partially extended position.

Referring now to the drawings and initially to FIG. 1, an antenna 10 comprises a telescoping antenna body 12 which is coaxially mounted to a cylindrical base 14 so as to be telescopically retractable and extendable with respect thereto. Preferably this base 14 is mounted within the casing or housing (not shown) of a radio. The antenna body 12 preferably comprises a plurality of coaxially arranged metallic tubes which can be readily extended to a desired length to act as an antenna.

Figure 2:
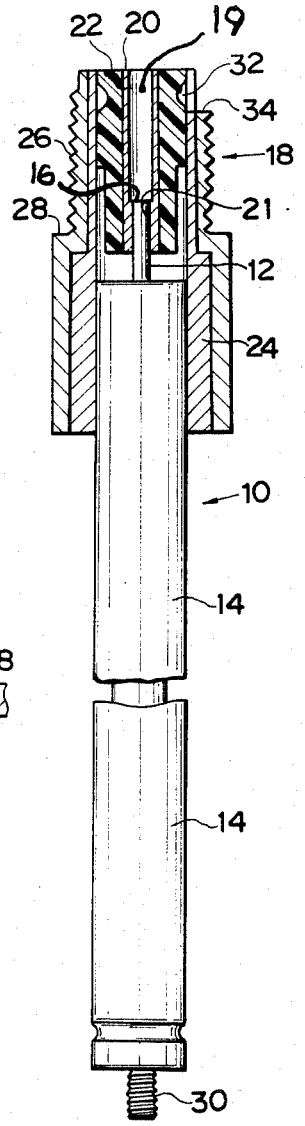
FIG. 2 is a side elevation, partially in section, of the antenna of FIG. 1 in a fully retracted position wherein it defines a coaxial connector receptacle.

When the telescoping antenna body 12 is fully retracted with respect to the base 14 (as shown in FIG. 2), the female or receptacle unit of a coaxial connector is defined. In this regard, the axially outer or free end 16 of the telescoping antenna body 12 mounts a cylindrical metallic electrode 20 having an axial bore 19 adapted to receive the center electrode of a conventional coaxial connector male unit or jack (not shown). A plastic tubular insulating member 22 surrounds the cylindrical electrode 20.

As best shown in FIG. 2, the cylindrical electrode 20 is coupled with the axially outer or free end 16 of the telescoping antenna body 12 by suitable means. In the illustrated embodiment, this coupling is achieved by sizing the axially inner end 21 of the cylindrical electrode 20 to receive the axially outer end 16 of the antenna body 12 in a press fit. The remaining portion of a coaxial connector receptacle unit is defined by a mounting member 18 for the cylindrical base 14. This mounting member 18 comprises a generally cylindrical metallic body which has an externally threaded end 26. An insulating sleeve 24 is coaxially mounted inside of this cylindrical mounting member 18 and engages the cylindrical base 14 in a press fit at an axially inner portion thereof.

When the end 16 of the antenna is fully retracted with respect to the mounting member 18, as shown in FIG. 2, the cylindrical electrode 20 and externally threaded portion 26 of the mounting member 18 together form the female or receptacle unit of a coaxial connector. In order to electrically connect the antenna 12 to the radio (not shown) suitable means such as a screw terminal 30 is provided at the axially innermost or lower end of the cylindrical base 14, which is electrically coupled with the antenna by any suitable means (not shown).

Figure 3:
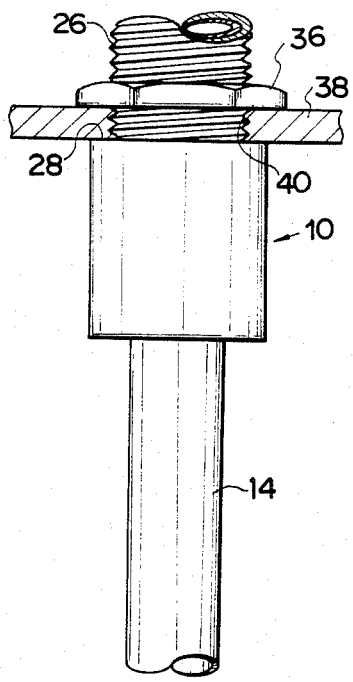
FIG. 3 is a partial view showing the mounting of the antenna of FIGS. 1 and 2 to the casing of a radio set, for example.

In order to extract the end of the antenna 12 from the fully retracted position shown in FIG. 2, a circumferential groove 32 is provided in the axially outer end part of the insulator member 22. Cooperatively, a cut out portion 34 is provided in the threaded member 26 and insulating sleeve 24 thereunder to permit gripping of this groove 32. Referring now to FIG. 3, the mounting member 28 may be threadably advanced or otherwise engaged through a wall or panel 38 of a radio casing or housing. This panel 38 may be provided with a suitable threaded aperture 40 as illustrated in FIG. 3 for this purpose. Preferably, the outer diameter of the threaded portion 26 of the mounting member 18 is somewhat less than the remainder thereof whereby a convenient shoulder 28 is provided to bear against the inner surface of this panel 38 about the aperture 40. A suitable nut 36 may be threadably engaged with the threaded portion 26 of the mounting member 18 and advanced to bear against the outer or top surface of the panel 38.

Advantageously, the metal-to-metal connection between the shoulder portion 28, the nut 36 and the panel 38 provides an electrical ground connection for the mounting member 18, whereby the outer threaded surface 26 provides a ground connection for a conventional coaxial cable connector. A suitable cap (not shown) may also be used to protect the retracted connector portion 20, 22 when in fully retracted position as shown in FIG. 2.

The invention has been illustrated and described hereinabove with reference to a preferred embodiment, however, the invention is not limited thereto. Those skilled in the art may devise various alternatives, changes and modifications upon reading the foregoing description. The invention includes such alternatives, changes and modifications insofar as they fall within the spirit and scope of the appended claims.

The invention is claimed as follows:

1. An antenna comprising: an antenna body telescopically extendable from a fully retracted position and having a free end; an electrode member mounted to the free end of said antenna body, said electrode member having a tubular, electrically conductive portion electrically coupled to the antenna body and defining an axial bore; base means for mounting said antenna body to a radio, said base means including a casing member for telescopically mounting said antenna body and a receptacle portion for coaxially receiving said electrode member when the antenna body is in said fully retracted position; said electrode member and said receptacle portion of said base means together forming a coaxial connector receptacle when said antenna body is in said fully retracted position.

2. An antenna according to claim 1 wherein said electrode member further includes a tubular insulator member surroundingly engaging said tubular, electrically conductive portion.

3. An antenna according to claim 1 and further including means for facilitating the extraction of said electrode member from said axially outer portion of said base means when said antenna body is in said fully retracted position.

4. An antenna comprising: an antenna body telescopically extendable from a fully retracted position and having a free end; an electrode member mounted to the free end of said antenna body, said electrode member having a tubular, electrically conductive portion electrically coupled to the antenna body and defining an axial bore; base means for mounting said antenna body to a radio, said base means including a casing member for telescopically mounting said antenna body and a receptacle portion for coaxially receiving said electrode member when the antenna body is in said fully retracted position; said electrode member and said receptacle portion of said base means together forming a coaxial connector receptacle when said antenna body is in said fully retracted position; and wherein said receptacle portion of said base means is provided with an external thread surface for receiving a complementary threaded portion of a coaxial connector jack.

5. An antenna according to claim 4 wherein said base means includes a generally cylindrical mounting member for mounting said casing member and said antenna body to a radio; and wherein said mounting member defines said receptacle portion of said base means including said external thread surface.

6. An antenna according to claim 5 wherein said mounting member further includes a tubular insulating member coaxially mounted within said external thread surface thereof for coaxially receiving said electrode insulating member therewithin.

7. An antenna comprising: an antenna body telescopically extendable from a fully retracted position and having a free end; an electrode member mounted to the free end of said antenna body; base means for mounting said antenna body to a radio, said base means including a first portion for telescopically mounting said antenna body and a second portion for receiving said electrode member when the antenna body is in said fully retracted position; said electrode member and said second portion of said base means together forming a coaxial connector receptacle when said antenna body is in said fully retracted position.

8. An antenna comprising: an antenna body telescopically extendable from a fully retracted position and having a free end; an electrode member mounted to the free end of said antenna body, said electrode member having a tubular, electrically conductive portion electrically coupled to the antenna body and defining an axial bore; base means for mounting said antenna body to a radio, said base means including a casing member for telescopically mounting said antenna body and a receptacle portion for coaxially receiving said electrode member when the antenna body is in said fully retracted position; said electrode member and said receptacle portion of said base means together forming a coaxial connector receptacle when said antenna body is in said fully retracted position; and further including means for facilitating the extraction of said electrode member from said axially outer portion of said base means when said antenna body is in said fully retracted position; said extraction facilitating means comprising an annular groove formed in an outer surface of said electrode member and a cut out portion in said receptacle portion of said base means to permit gripping of said annular groove when said antenna body is in said fully retracted position.

* * * * *